US007820109B2

(12) United States Patent
Nakajima et al.

(10) Patent No.: US 7,820,109 B2
(45) Date of Patent: Oct. 26, 2010

(54) TESTING CHIP AND MICRO ANALYSIS SYSTEM

(75) Inventors: Akihisa Nakajima, Sagamihara (JP); Kusunoki Higashino, Osaka (JP); Yasuhiro Sando, Amagasaki (JP)

(73) Assignee: Konica Minolta Medical & Graphic Inc., Tokyo (JP)

( * ) Notice: Subject to any disclaimer, the term of this patent is extended or adjusted under 35 U.S.C. 154(b) by 963 days.

(21) Appl. No.: 11/404,931

(22) Filed: Apr. 14, 2006

(65) Prior Publication Data

US 2006/0239862 A1 Oct. 26, 2006

(30) Foreign Application Priority Data

Apr. 20, 2005 (JP) ..... 2005-122165

(51) Int. Cl.
*B01L 3/02* (2006.01)

(52) U.S. Cl. ..... 422/100; 435/6; 435/287.2; 435/288.5; 204/601

(58) Field of Classification Search ..... 422/100; 435/6, 287.2, 288.5; 204/601
See application file for complete search history.

(56) References Cited

U.S. PATENT DOCUMENTS

| | | | | |
|---|---|---|---|---|
| 5,300,779 | A | 4/1994 | Hillman et al. | |
| 6,168,948 | B1 * | 1/2001 | Anderson et al. | 435/287.2 |
| 2003/0138941 | A1 * | 7/2003 | Gong et al. | 435/287.2 |

FOREIGN PATENT DOCUMENTS

| | | | |
|---|---|---|---|
| JP | 2001-322099 | A | 11/2001 |
| JP | 2003-181255 | A | 7/2003 |
| JP | 2003-190751 | A | 7/2003 |
| JP | 2004-028589 | A | 1/2004 |
| JP | 2004-108285 | A | 4/2004 |
| JP | 2004-270537 | A | 9/2004 |
| JP | 2005-43075 | A | 2/2005 |

OTHER PUBLICATIONS

Supplementary European Search Report in English, dated Nov. 26, 2009, issued in a counterpart European Application No. 06732131.5, 4 pages.
International Search Report in English, dated Aug. 8, 2006, issued in counterpart International Application No. PCT/JP2006/308273, 1 page.

* cited by examiner

*Primary Examiner*—Jyoti Nagpaul
(74) *Attorney, Agent, or Firm*—Holtz, Holtz, Goodman & Chick, PC

(57) ABSTRACT

A testing chip that analyzes a specimen includes: a reagent storage section; a mixing and reaction flow channel to perform a series of operations to mix a specimen and aqueous reagent, make the specimen and reagent react with each other, and detect the reaction; and a liquid feed control section provided between an outlet flow channel of the reagent storage section and the inlet of the mixing and reaction flow channel. Herein, aqueous reagent, lipophilic liquid, and aqueous liquid having greater surface tension than that of the aqueous reagent are disposed in the reagent storage section in this order toward the outlet flow channel, the aqueous liquid being stored in contact with the liquid feed control section; and aqueous liquid passes the micro flow path of the liquid feed control section by applying a liquid feed pressure higher than or equal to a predetermined pressure to the reagent storage section.

2 Claims, 7 Drawing Sheets

TESTING CHIP AND MICRO ANALYSIS SYSTEM

This application is based on Japanese Patent Application No. 2005-122165 filed on Apr. 20, 2005, in Japanese Patent Office, the entire content of which is hereby incorporated by reference.

FIELD OF THE INVENTION

The present invention relates to a testing chip, for analysis of a target substance in a specimen, which is provided with a series of micro flow channels in which a specimen and reaction reagent are mixed and react with each other so that the reaction is detected and relates to a micro analysis system using the testing chip, and particularly relates to improvement of a technology to seal aqueous reagent in a reagent storage section of a testing chip.

BACKGROUND OF THE INVENTION

In recent years, due to the demands of micro-machine technology and microscopic processing technology, systems are being developed in which devices and means (for example pumps, valves, flow paths, sensors and the like) for performing conventional sample preparation, chemical analysis, chemical synthesis and the like are caused to be ultra-fine and integrated on a single chip. This is also called μ-TAS (Micro Total Analysis System) bioreactor, lab-on-chips, and biochips, and much is expected of their application in the fields of medical testing and diagnosis, environmental measurement and agricultural manufacturing. As seen in gene testing in particular, in the case where complicated steps, skilful operations, and machinery operations are necessary, a micro analysis system which is automatic, has high speed and simple is very beneficial not only in terms of cost, required amount of sample and required time, but also in terms of the fact that it makes analysis possible in cases where time and place cannot be selected.

In various analysis and tests, quantitation of analysis, precision of analysis and economy are major factors in the development of the aforementioned analysis chip capable of producing results independently of place. To achieve this purpose, it is important to establish a highly reliable liquid feed system of simple structure. Thus, there has been an active demand for a reliable, high-precision micro fluid control device. The present inventors have already proposed a micro pump system and a control method capable of meeting such requirements (Patent Documents 2 and 4).

[Patent Document 1] TOKKAI No. 2004-28589

[Patent Document 2] TOKKAI No. 2001-322099

[Patent Document 3] TOKKAI No. 2004-108285

[Patent Document 4] TOKKAI No. 2004-270537

In analysis using the above micro analysis system, it is desirable that a predetermined amount of reagent is sealed in advance in a reagent storage section that communicates with a micro flow channel formed in a testing chip for analysis, in order to perform analysis and test quickly when necessary.

However, to seal reagent in a testing chip in advance, it requires prevention of evaporation of reagent during storage before using, prevention of leaking of the reagent from a reagent storage section during storage before using, and easy flow of the reagent from the reagent storage section to a successive flow channel when the chip is used.

On the other hand, it is necessary that the reagent is mixed with other liquids properly in successive channels and successive processes are performed properly, which does not allow inhibition for the sake of the above requirements.

An object of the invention is to provide a testing chip for analysis of a target substance in a specimen and a micro analysis system using the chip, wherein reagent sealed in a reagent storage section in advance does not denaturate through evaporation or the like nor leaks out to an external, and further, it is easy to make the reagent flow from the specimen storage section to a successive flow channel when using it.

In addition to the above object, another object of the invention is to provide a testing chip and a micro analysis system using the chip which provide reagent to a successive process properly.

SUMMARY OF THE INVENTION

In a first aspect of the invention, there is provided a testing chip for analysis of a specimen, including:

(1) a reagent storage section that stores aqueous reagent in advance; (2) a mixing and reaction flow channel to perform a series of operations to mix a specimen and an aqueous reagent, make the specimen and reagent react with each other, and detect the reaction; and (3) a liquid feed control section provided between an outlet flow channel of the reagent storage section and an inlet of the mixing and reaction flow channel, wherein, the liquid feed control section has a micro flow path with a smaller flow channel cross-sectional area than those of the outlet flow channel of the reagent storage section and the inlet of the mixing and reaction flow channel; an aqueous reagent, a lipophilic liquid, and an aqueous liquid having a greater surface tension than that of the aqueous reagent are disposed in the reagent storage section in this order toward the outlet flow channel, the aqueous liquid being stored in contact with the liquid feed control section; and the aqueous liquid passes the micro flow path of the liquid feed control section by applying a liquid feed pressure higher or equal to a predetermined pressure to the reagent storage section.

In a second aspect of the invention, the testing chip in the first aspect includes:

a first flow channel from the reagent storage section toward a downstream;

a second flow channel that branches from the first flow channel and feeds the aqueous reagent to a next process; and first and second liquid flow control sections, wherein, the first liquid feed control section is disposed for the first flow channel at a position ahead a branch point with the second flow channel;

the second liquid feed control section is disposed for the second flow channel and near the branch point from the first flow channel;

each of the first and second liquid feed control sections includes a micro path which makes flow channels on an upstream side and downstream side communicate with each other, has an flow channel cross sectional area smaller than those of the communicating channels, prohibits passing of a liquid until the liquid feed pressure in a vicinity of an inlet of the micro path reaches a respective predetermined pressure, and allows passing of the liquid when the liquid feed pressure is higher than or equal to the predetermined pressure, and the liquid feed pressure that allows passing of liquid is lower at the second liquid feed control section than at the first liquid feed control section.

In a third aspect of the invention, there is provided a micro analysis system that includes:

the testing chip in the first aspect; and a system main body, wherein, the system main body includes a micro pump unit provided with a chip connecting section having flow channel openings to communicate with micro flow channels of the testing chip, a plurality of micro pumps, a detection processing device to detect reaction in the testing chip, and a control device to control the micro pump unit and the detection processing device;

the testing chip includes a pump connecting section having flow channel openings to communicate with the micro pumps; and the testing chip gets mounted inside the system main body in a state that the pump connecting section of the testing chip and the chip connecting section of the micro pump unit are in tight liquid contact, and then a specimen in the testing chip is analyzed.

DETAILED DESCRIPTION OF THE PREFERRED EMBODIMENT

Figure 1:
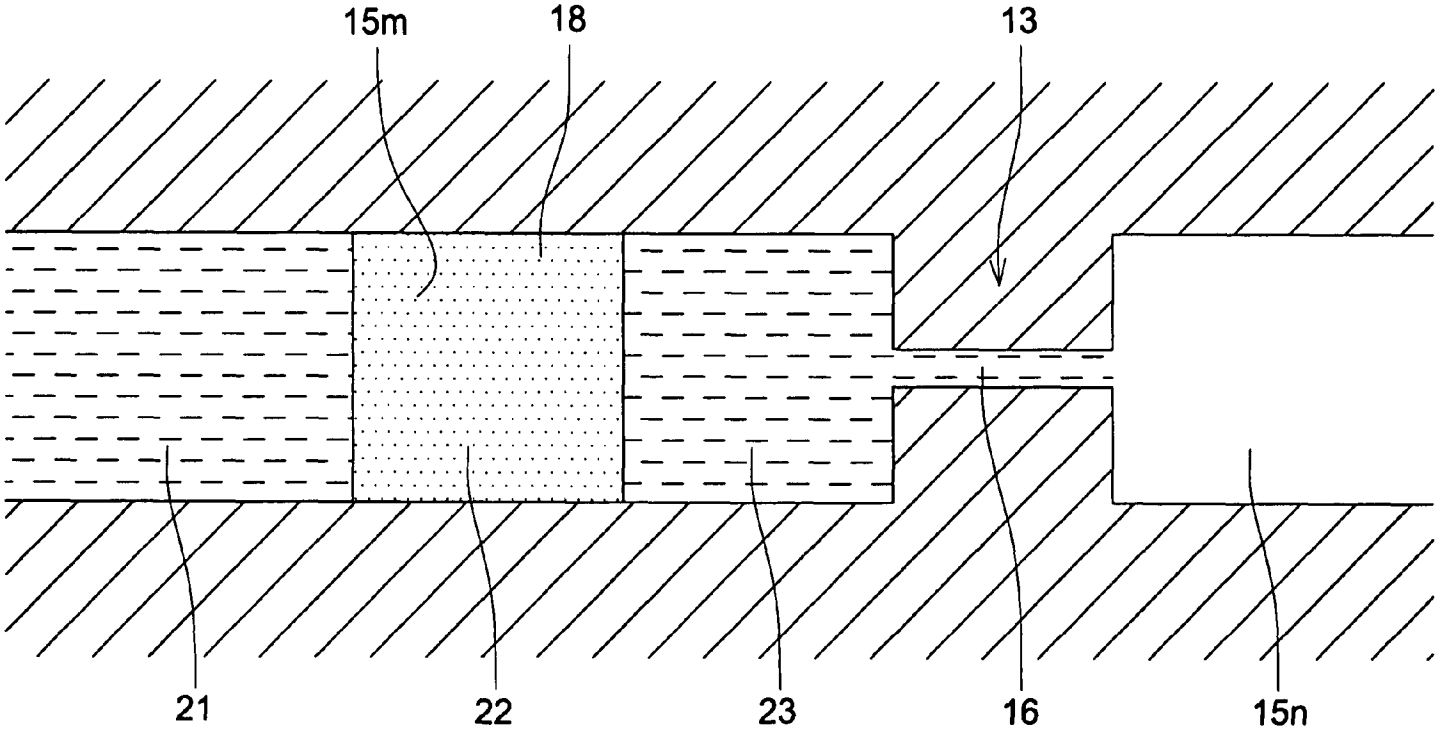
FIG. 1 is a cross-sectional view showing the peripheral of the downstream side end portion of a reagent storage section of a testing chip in accordance with the invention.

The invention includes the following items.

Item 1

A testing chip that analyzes a target material in a specimen and is provided with a micro flow channel for performing a series of operations to mix the specimen and reaction reagent, make them react with each other, and detect the reaction. The testing chip includes: a reagent storage section that is provided in the micro flow channel and stores aqueous reagent in advance; and a liquid feed control section that has a liquid feed control path and is provided at an end on a downstream side of the reagent storage section. Herein, the control path makes flow channels on a reagent storage section side and on a downstream side thereof to communicate with each other and has a flow channel cross sectional area smaller than those of the communicating channels; the liquid feed control section prohibits passing of liquid until a liquid feed pressure in a normal direction from an upstream side to the downstream side reaches a predetermined pressure and allows passing of the liquid when a liquid feed pressure higher than or equal to the predetermined pressure is applied; and the reagent storage section stores an aqueous reagent, lipophilic liquid, and aqueous liquid in this order toward the downstream side, the aqueous liquid being in contact with the liquid feed control section.

Item 2

The testing chip of Item 1 further included: a first flow channel from the reagent storage section to the downstream; a second flow channel that branches from the first flow channel and feeds the aqueous reagent to a next process; and first and second liquid feed control sections each of which has a liquid feed control path which makes flow channels on the upstream side and downstream side communicate with each other, has a flow channel cross sectional area smaller than those of the communicating channels, prohibits passing of liquid until the liquid feed pressure in the normal direction from the upstream side to the downstream side reaches a respective predetermined pressure, and allows passing of the liquid when a liquid feed pressure higher than or equal to the predetermined pressure is applied, the liquid feed pressure capable of passing liquid being smaller at the second liquid feed control section than at the first liquid feed control section. Herein, the first liquid feed control section is disposed for the first flow channel at a position ahead a branch point with the second flow channel; and the second liquid feed control section is disposed for the second flow channel in a vicinity of the branch point from the first channel.

Item 3

An integrated micro analysis system includes: the testing chip of Item 1 or 2; and a system main body, wherein, the system main body includes a base main body; a micro-pump unit provided with a chip connecting section having flow channel openings to communicate with micro flow channels of the testing chip and a plurality of micro pumps; a detection processing device to detect reaction in the testing chip; and a control device to control the micro-pump unit and the detection processing device; the testing chip includes a pump connecting section having flow channel openings to communicate with the micro pump; and the testing chip gets mounted inside the system main body in a state that the pump connecting section of the testing chip and the chip connecting section of the micro-pump unit are in tight liquid contact, and then a target material in the specimen in the testing chip is analyzed.

In a testing chip in accordance with the invention, respective flow channel elements and structural sections are disposed at positions that are functionally proper so that the chip can be used as a microreactor for chemical analysis, various tests, processing and separation of specimen, chemical synthesis and the like.

A plurality of reagent storage sections are provided in the testing chip to store respective reagents, and the reagent storage sections contain reagent, washing solution, denaturation solution and the like to be used for a predetermined reaction. This is because it is desirable that reagent is stored in advance so that a test can be quickly performed regardless of time and place.

A testing chip can be produced, for example, by using a channel-formed substrate which is a substrate having been formed with grooves in advance for flow channels and the like, and a covering substrate that is tightly contacted with this channel-formed substrate. The channel-formed substrate is formed with respective structural sections and flow channels communicated with the structural sections. Concrete examples of these structural sections are a pump connecting section; respective storage sections (reagent storage section, specimen storage section, etc.); fluid reservoir sections including a waste fluid reservoir section; control parts to control liquid feeding, such as a valve seat section, a liquid feed control section (shown in FIG. 1), a reverse flow preventing section (a check valve, active valve, etc.), a specimen quantitation section, and a mixing section; a reaction section; and a detection section. The covering substrate may be formed with such structures and flow channels. A testing chip is produced by covering the structural sections and flow channels such that the channel-formed substrate and the covering substrate are tightly contacted. In a case of optically detecting a reaction in the testing chip, at least the detection section out of the structural sections is needed to be covered by a tight contact with a light transmittable covering substrate.

A testing chip is produced with a forming material or produced by properly combining more than one forming materials. Forming materials for testing chips include, for example, plastic resins, various inorganic glasses, silicon, ceramics, and metals.

Chips for specimens, to be measured, in a large number, particularly, clinical specimens with a possibility of contamination and infection, should preferably be disposable. Preferably, plastic resins are used as forming materials for testing chips in a view of multi-purpose versatility and mass productivity.

For the substrate such as channel-formed substrate where flow channels are formed, a resin having water repellency and hydrophobicity in which the flow channels hardly distort by absorbing water and infinitesimal amount of specimen fluid can be fed without wasting in the way is preferred. For these materials, Resin, such as polystyrene, polyethylene, polypropylene, a polyethylene terephthalate, polyethylenenaphthalate, polyethylene vinyl alcohol, polycarbonate, poly methyl pentene, fluorocarbon, and saturation annular polyolefin. Polystyrene based plastics are preferred to channel-formed substrate. Because polystyrene is superior at transparency, mechanical characters and molding character, micro work is easily applied on it.

In the case where heating up to nearly 100° C. is necessary for analysis, a resin which is excellent in heat resistance, such as polycarbonate, polyimide, polyether imide, poly Benz imidazole, polyetheretherketoneare, is used as a material for a substrate.

To promote reaction of analyte, often a predetermined portion of a flow channel or a reaction part in micro reactor is heated up to a predetermined temperature. In the area to be heated, the temperature of spot heating is usually up to around 100° C. On the other hand, in the case of a specimen that becomes unstable at high temperature, the reagent is needed to be cooled. Considering such rise and fall of the temperature of a local area in the chip, a material of adequate thermal conductivity is selected preferably. For such materials, resin material and glass are given. By forming these areas with a material having a small thermal conductivity, spreading of heat on the surface is controlled and solely the area to be heated can be selectively heated.

To detect fluorescent matters or products of color reaction optically, at least the region, of the surface of the testing chip, which covers the detection part of a micro flow channel needs to be a light transmittable member. Therefore, as a material, of the covering substrate, to cover the detection portion, transparent materials, such as alkali glass, quartz glass, transparent plastics can be used. Such a light transmittable covering substrate may cover the entire top surface of the testing chip.

The micro flow channels of the testing chip as a micro reactor are formed on the substrate in accordance with allocation of the flow channels designed in advance for the purpose. The flow channels in which liquid flows are micro flow channels of a micro meter order width that are formed to have, for example, a width of several dozen to several hundred μm and preferably 50 to 100 μm, a depth of 25 to 400 μm and preferably 50 to 300 μm. If the width of flow channels is narrow, flow path resistance of the flow channel increases and it is inconvenient for fluid feeding and the like. If the width of the flow channels is exceedingly wide, the advantage of the micro scale space is reduced. The longitudinal and lateral dimensions are typically several dozen millimeters, and the height is several millimeters.

The respective structural sections and flow channels of the substrate are formed based on prior micro processing technologies. Typically, transferring of micro structural sections using photosensitive resin through a photolithography technology is preferred. Using the transferred structural sections, removal of unnecessary parts, adding of necessary parts and transferring of shapes are carried out. After making a pattern, which forms the constructive elements of the chip by photolithography technology, the pattern is transformed onto a resin.

Therefore, for the material of a basic substrate, which forms the minute flow channels of a micro reactor, a resin that can transfer a sub-micron structural section accurately and is excellent in mechanical characteristics is preferably used. Especially, polystyrene and polydimethylsiloxane are excellent in shape transferring. If necessary, processing to form the respective structural sections and channels of the substrate may be performed by injection molding and extrusion molding.

A pump connecting section is provided on the upstream side of the micro flow channels of the testing chip, for example, on the upstream side of storage sections which stores respective liquids, such as reagent and a specimen, so that the flow channels are connected to external micro pumps. Flow channel openings that communicate with the above described storage sections are provided at the pump connecting section, and driving liquid is fed from the flow channel openings by the micro pumps to push out the liquids in the respective storage sections to the downstream side. The micro pumps may be provided in the testing chip but typically are installed to the system main body in which are integrally incorporated units to perform control of liquid feeding, control of temperature of the testing chip, detection of reaction in the micro flow channels in the testing chip and the like.

In a testing chip in accordance with the invention, reagent storage sections storing respective kinds of aqueous reagent have a structure described below. FIG. 1 is a cross-sectional view showing the periphery of the downstream side end portion of a reagent storages section of a testing chip in accordance with the invention.

As shown, in a reagent storage section 18 storing an aqueous reagent 21, a lipophilic liquid 22 in contact with the aqueous reagent 21 at the boundary surface and an aqueous liquid 23 in contact with the lipophilic liquid 22 at the boundary surface are stored in this order in the downstream side of the aqueous reagent 21.

The aqueous liquid 23 stored on the most downstream side of the reagent storage section 18 is in contact with a liquid feed control path 16 with a small diameter and inhibited from flowing out to a flow channel 15*n* ahead. The liquid control path 16 makes a flow channel 15*m* including the reagent storage section 18 and the flow channel 15*n* on the downstream side to communicate with each other, and the cross-sectional area (the cross-sectional area of the cross section vertical to the flow channel) is smaller than the cross sectional area of the flow channels 15*m* and 15*n*.

The flow channel walls of the series of flow channels from the flow channel 15*m* via the liquid feed control path 16 to the flow channel 15*n* are formed of hydrophobic material such as plastic resin. Accordingly, the aqueous liquid 23 in contact with the flow channel 15*n* is inhibited from passing to the flow channel 15*n* by the difference in surface tension from the flow channel wall.

The sizes of the flow channel 15*m*, the liquid feed control path 16, and the flow channel 15*n* are not limited as long as liquid is inhibited from passing to the flow channel 15*n*, as described above. As an example, a liquid feed control path 16 is formed with the longitudinal and lateral dimensions of approximately 25 μm×25 μm for the flow channels 15*m* and 15*n* with the longitudinal and lateral dimensions of 150 μm×300 μm.

The upstream side of the reagent storage section 18 is communicated with a micro pump 11 which is connected via the pump connecting section 12 of the testing chip. To flow out the aqueous reagent 21 from the reagent storage section 18 to the flow channel 15*n*, a liquid feed pressure greater than a predetermined pressure is applied by the micro pump 11, and thereby the aqueous liquid 23 is pushed out from the liquid feed control path 16 to the flow channel 15*n* against the surface tension. After the aqueous liquid 23 has flowed out to the flow channel 15*n*, the liquids stored in the reagent storage section 18 flow to the flow channel 15*n* even without maintaining the liquid feed pressure that was required in order to push out the front end of the aqueous liquid 23 to the flow channel 15*n*.

In such a manner, a liquid feed control section 13 is arranged to inhibit liquids stored in the reagent storage section 18 from passing, by the use of the downstream side end portion of the flow channel 15*m*, the liquid feed control path 16, and the upstream side of the flow channel 15*n* of the reagent storage section 18, until the liquid feed pressure in the normal direction from the upstream side to the downstream side reaches a predetermined pressure, and to make the liquids pass by applying a liquid feed pressure greater than or equal to the predetermined pressure.

As described above, in accordance with the invention, since the liquid feed control section is provided at the end portion on the downstream side of the reagent storages section, liquid contained in the reagent storage section is prevented from leaking out further than the liquid feed control path during storage of the testing chip, and also, a liquid feed pressure higher than a predetermined pressure is applied with a micro pump connected to the upstream side of the reagent storage section at the time of use to push out the liquid contained in the reagent storage section to a successive flow channel, making it possible to easily make the aqueous reagent flow out to the successive flow channel.

If the flow walls of the series of flow channels from the flow channel 15*m* via the liquid feed control path 16 to the flow channel 15*n* are formed of a hydrophilic material such as glass, it is necessary to perform water-shedding coating, for example, fluorine coating at least on the inner surface of the liquid control path 16.

Although it is possible to use, for example, buffer liquid with an ordinary composition as the aqueous liquid 23, it is necessary to use a liquid which is hydrophilic enough so that the difference in surface tension between the aqueous liquid and the inner surface of the liquid feed control path 16 inhibits the aqueous liquid 23 from passing the liquid control path 16 until the liquid feed pressure reaches a predetermined pressure. The storage amount of the aqueous liquid 23 in the reagent storage section 18 is also determined for this purpose The lipophilic liquid 22 is used to prevent evaporation (and leakage, entrance of gas, contamination, denaturation, etc.) of the aqueous reagent 21 during storage of the testing chip or the like, and the storage amount in the reagent storage section 18 is also determined for this purpose. As the lipophilic liquid 22, it is possible to use, for example, a liquid that solidifies under refrigeration during storage of the testing chip, and melts when the temperature of the testing chip is raised to a room temperature when it is used and goes into a flux state. Concretely, oil with a solubility smaller than 1% for water can be used, for example.

Though not shown in FIG. 1, the lipophilic liquid 22 is also stored on the upstream side of the reagent storage section 18 in contact with the aqueous reagent 21.

In accordance with the invention, since the lipophilic liquid is stored in the reagent storage section to seal the aqueous reagent, evaporation of the reagent is prevented during storage. Further, since aqueous liquid with a large difference in surface tension from the hydrophobic flow channel wall is stored on the downstream side of the lipophilic liquid, water-repelling function at the above liquid feed control section works to block the aqueous liquid from flowing out further than the liquid feed control path. Accordingly, the aqueous reagent is prevented from leaking out to the flow channel on the downstream side during storage.

Figure 2:
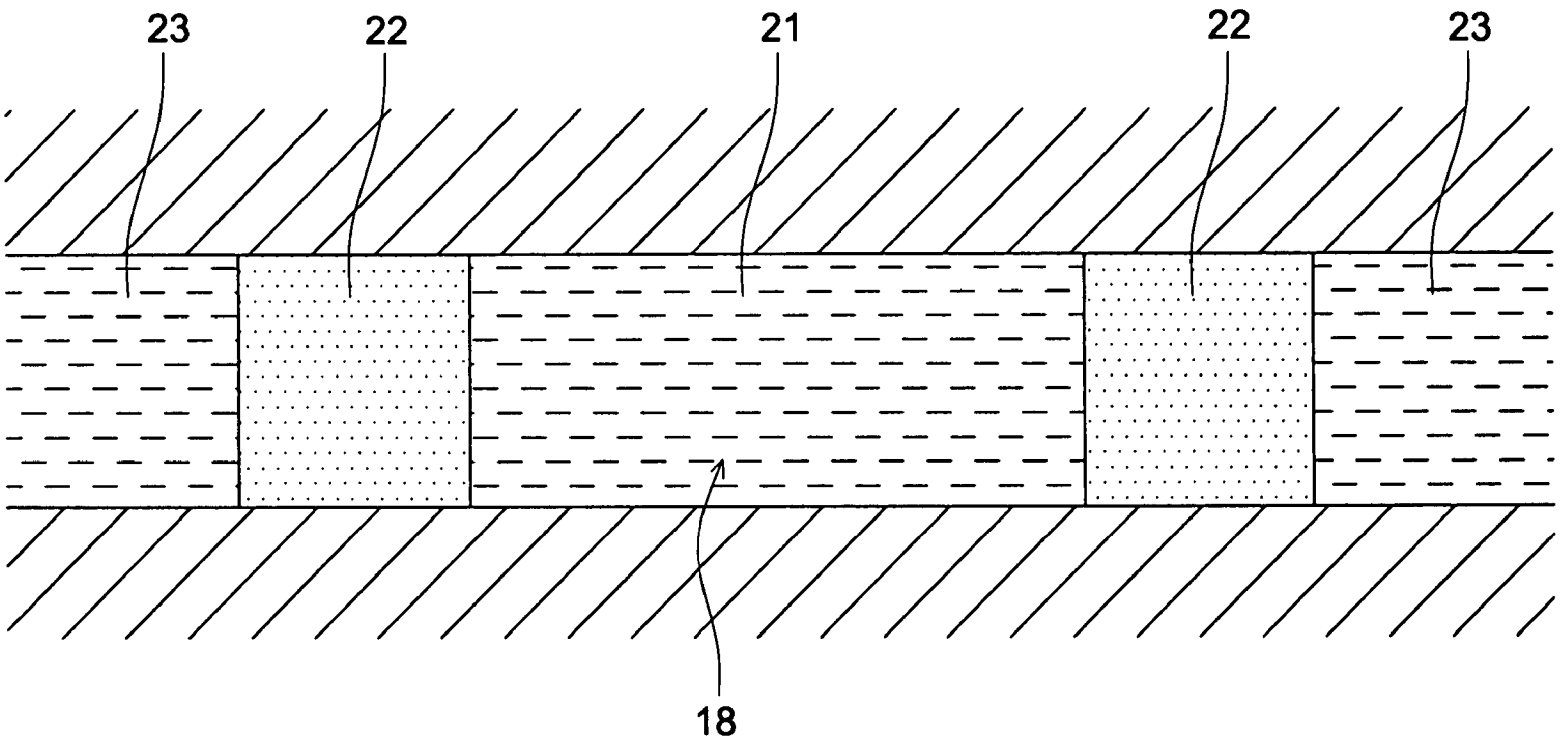
FIG. 2 is a cross-sectional view of a reagent storage section and shows an example of an embodiment of storing aqueous reagent, solvent liquid, and aqueous liquid in a reagent storage section.
Figure 3:
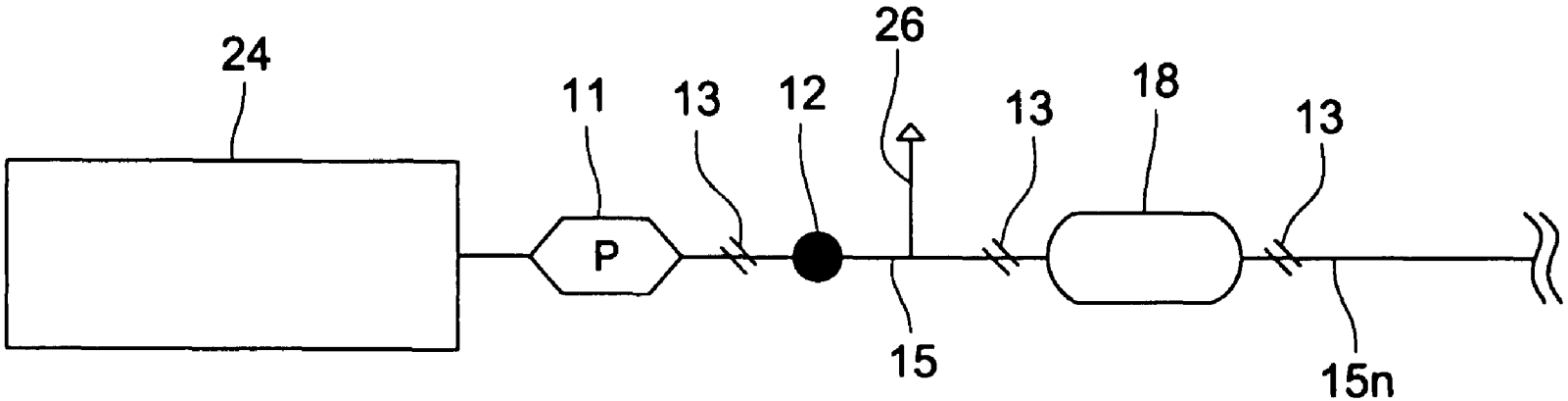
FIG. 3 is a diagram illustrating a structure in which a micro pump is connected on the upstream side of a reagent storage section of a testing chip.

Thus, the aqueous reagent 21 stored in the reagent storage section 18 is perfectly sealed by the lipophilic liquid 22 from the both end sides. An example of the state of storing the respective liquids in the reagent storage section 18 is shown in FIG. 2. In this example, from the upstream side to the downstream side in the reagent storage section 18, the aqueous liquid 23, the lipophilic liquid 22, the aqueous reagent 21, the lipophilic liquid 22, and the aqueous liquid 23 are stored in this order. It is necessary to provide the liquid feed control path 16 in FIG. 1 at the downstream side end portion of the reagent storage section 18, and in addition, another liquid feed control path 16 may be provided at the upstream side end portion of the reagent storage section 18 likewise.

In the testing chip in accordance with the invention, at least one of the reagent storage sections which store respective aqueous reagents has the structure described above. As aqueous reagent, a reagent (reagents such as primer in the PCR method) to be mixed with a specimen and react with it is a typical example, but aqueous reagent is not limited thereto. Other reagents to be stored in the testing chip may be employed, such as a reagent to perform pre-processing of a specimen, a reagent to perform various processing of the liquid after the reaction between the specimen and the reaction reagent. Specifically, denaturation solution to denaturate a gene amplified by a reaction with a reaction reagent and a probe DNA solution that hybridizes the amplified gene are examples.

The shape of a reagent storage section may be various, including a thin channel form and a wide channel form as long as a liquid feed control section 13 can be constructed at least at the downstream end portion. Further, reservoir sections in a liquid reserving form to individually reserve the lipophilic liquid 22 and the aqueous liquid 23 may be provided in the reagent storage section 18.

Figure 4:
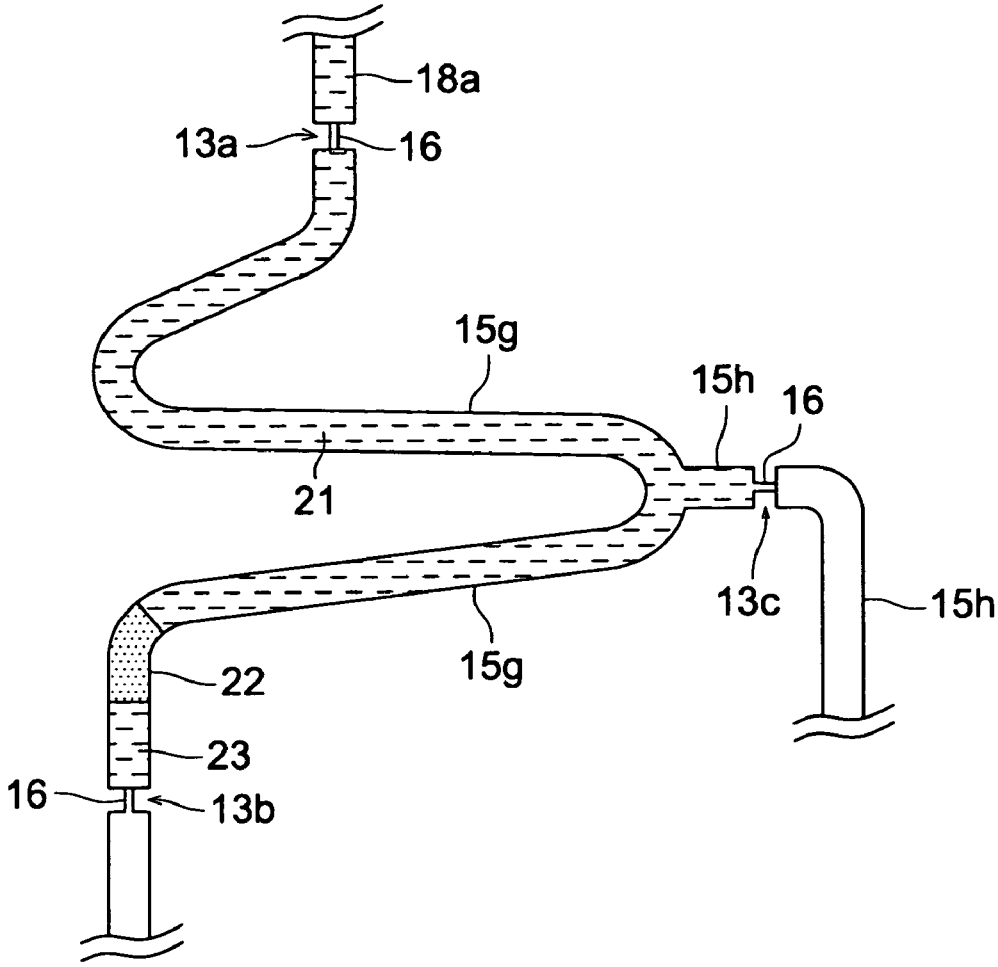
FIG. 4 is a diagram showing the structure of micro flow channels on the downstream side of a reagent storage section of a testing chip in accordance with the invention.
Figure 5:
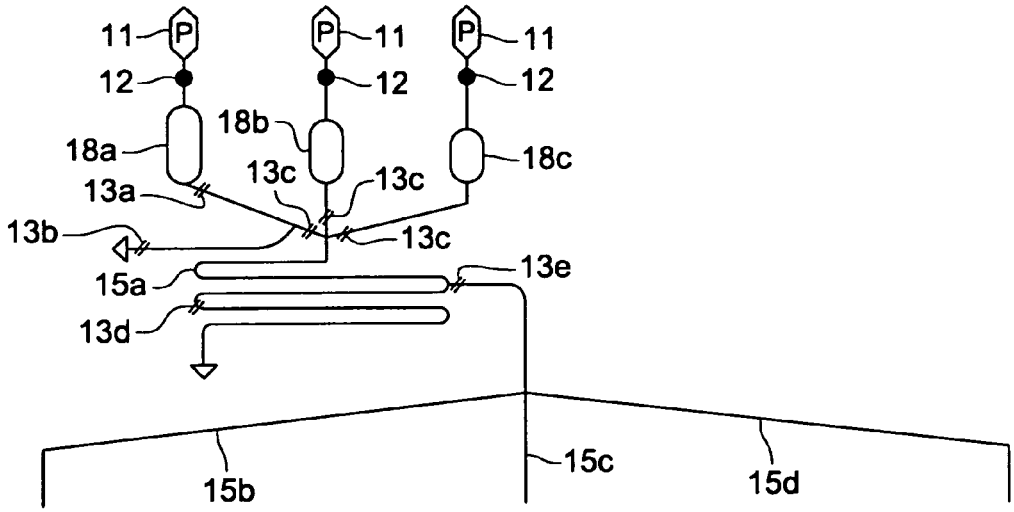
FIG. 5 is a diagram illustrating an example of a flow channel structure of a testing chip in accordance with the invention and shows a flow channel structure from reagent storage sections to flow channels for analysis.

In a testing chip in a preferred embodiment of the invention, a reagent storage section storing aqueous reagent has the above described structure and the flow channel on the downstream side has the following structure. Taking a case where aqueous reagent is a reagent to be reacted with a specimen, as an example, the flow channel structure will be described below. FIG. 4 is a diagram showing the structure of a micro flow channel on the downstream side of a reagent storage section of a testing chip in accordance with the invention. FIG. 5 is a diagram showing the structure of a flow channel to mix a plurality of reagents and feed the mixed reagent to an analysis channel on the downstream side.

As shown in FIG. 4, the first flow channel 15*g* extending from the reagent storage section 18*a* to the downstream is provided on the downstream side of the reagent storage section 18*a*. At a midway of the first flow channel 15*g*, the second flow channel 15*h* branches from the first flow channel 15*g* so that the reagent is fed to the next process (in the present embodiment, a process to mix plural reagents in the flow channel 15*a* in FIG. 5).

At the position ahead from the branch point on the first flow channel 15*g* between the first flow channel 15*g* and the second flow channel 15*h*, disposed is the first liquid feed control section 13*b* provided with the above described liquid feed control path 16. Further, at the position on the second flow channel 15*h* near the branch point between the second flow channel 15*h* and the first flow channel 15*g*, disposed is the second liquid flow control section 13*c*.

By applying a liquid feed pressure higher than or equal to a predetermined pressure with a micro pump (not shown) that is connected to the upstream side of the reagent storage section 18*a*, the contained liquid in the reagent storage section 18*a* is pushed out via the liquid feed control path 16 of the liquid feed control section 13*a* provided on the downstream side end portion of the reagent storage section 18*a* into the first flow channel 15*g*, and then the aqueous liquid 23 at the front end portion and the lipophilic liquid 22 (see FIG. 1) pass the branch point between the first flow channel 15*g* and the second flow channel 15*h* and reach the first liquid feed control section 13*b*.

The liquid feed pressure which enables the aqueous reagent 21 in the second liquid feed control section 13*c* to pass is lower than the liquid feed pressure which enables the aqueous liquid 23 in the first liquid feed control section 13*b* to pass. Specifically, for example, by having the cross sectional area of the liquid feed control path 16 at the second liquid feed control section 13*c* be larger than the cross sectional area of the liquid feed control path 16 at the first liquid feed control section 13*b*, it is possible to make a difference between the liquid feed pressures which enable liquid to pass the respective liquid feed control paths 16. Or, depending on the case, it is also possible to make a difference between the liquid feed pressures which enable liquid to pass, by arranging such that the difference in surface tension between liquid and the flow channel wall of the liquid feed control path 16 at the first liquid control section 13*b* is not equal to that at the second liquid feed control section 13*c*.

In the present embodiment, the front end portion of the contained liquid having been pushed out from the reagent storage section by the micro pump passes the branch point between the first and second flow channels to the side of the first flow channel, and is blocked from moving at the first liquid feed section. Thereafter, a liquid feed pressure that blocks liquid from flowing out at the first liquid feed control section and allows the aqueous liquid to pass from the second liquid fees control section with the micro pump. Thus, the aqueous reagent flows out of the second control section and is fed to a successive process.

Accordingly, the lipophilic liquid and the aqueous liquid on the front end side of the contained liquid having been pushed out of the reagent storage section are trapped by the first liquid feed control section, not to flow out to the second flow channel, and only the aqueous reagent is fed to the second flow channel. Thus, it is possible to avoid a problem that liquid other than aqueous reagent is sent to a flow channel in which a successive process is performed.

After the front end portion of the aqueous liquid 23 reaches the liquid feed control section 13*b*, the liquid feed pressure is further increased by the micro pump to a liquid feed pressure that allows the aqueous reagent 21 to pass the second liquid feed control section 13*c*, and thereby the aqueous reagent 21 passes to the second flow channel 15*h* ahead from the second liquid feed control section 13*c*. Thus, only the aqueous reagent 21 is fed to the next process from the second flow channel 15*h*, while the aqueous liquid 23 and the lipophilic liquid 22 are left in the first flow channel 15*g*.

In such a manner, since the aqueous liquid 23 and the lipophilic liquid 22 are prevented from being fed to the flow channel directed to the next process, it is possible to avoid a problem which could be caused if it occurred. The aqueous liquid 23 and the lipophilic liquid 22 are pushed out at a proper time from the first liquid feed control section 13*b* by increasing the liquid feed pressure by the micro pump, for example, to be received and stored by a waste liquid reservoir storage.

If the aqueous reagent contains surfactant, since the difference in the tension force between the flow wall and the aqueous reagent is smaller, the second liquid feed control section 13*c* does not always function. In such a case, the same control as described above can be achieved by providing an active valve at the part of the liquid feed control section 13*c*.

FIG. 5 shows the flow channel structure in FIG. 4 in terms of the flow channel on the downstream side of a reagent storage section only for the reagent storage section 18*a*, while those for the reagent storage sections 18*b* and 18*c* are omitted in FIG. 5. However, needless to say, the same flow channel structure in FIG. 4 can be arranged also for the reagent storage sections 18*b* and 18*c*.

In FIG. 5, the respective aqueous reagents which are led from the reagent storage section 18*a* to 18*c*, to the liquid feed control sections 13*c*, are introduced to the flow channel 15*a* ahead of the liquid feed control sections 13*c* by increasing the liquid feed pressure by micro pumps 11 connected to the upstream sides of the reagent storage sections 18*a* to 18*c*, and mixed with each other. Also in the flow channel 15*a* to mix the respective reagents, the same flow channel structure as shown in FIG. 4 is arranged with the liquid feed control section 13*d* (corresponding to the first liquid feed control section 13*b* in FIG. 4) and the liquid feed control section 13*e* (corresponding to the second liquid control section 13*c* in FIG. 4) to trap the front end portion of the mixed reagent at the liquid feed control section 13*d*, thereby preventing feeding the front end portion of the mixed reagent of which the mixing ratio is not stabilized to the next process.

As shown in FIG. 5, the reagent having been mixed in the flow channel 15*a* is fed to the flow channels 15*b*, 15*c*, and 15*d*. Though not shown, the mixed reagent and a specimen are mixed in these flow channels, and reactions between them and detections of the reactions are performed. By providing a plurality of analysis flow channels 15*b* to 15*d*, simultaneous analyses, such as simultaneous multi-item analysis, positive control, negative control, are performed.

Figure 6:
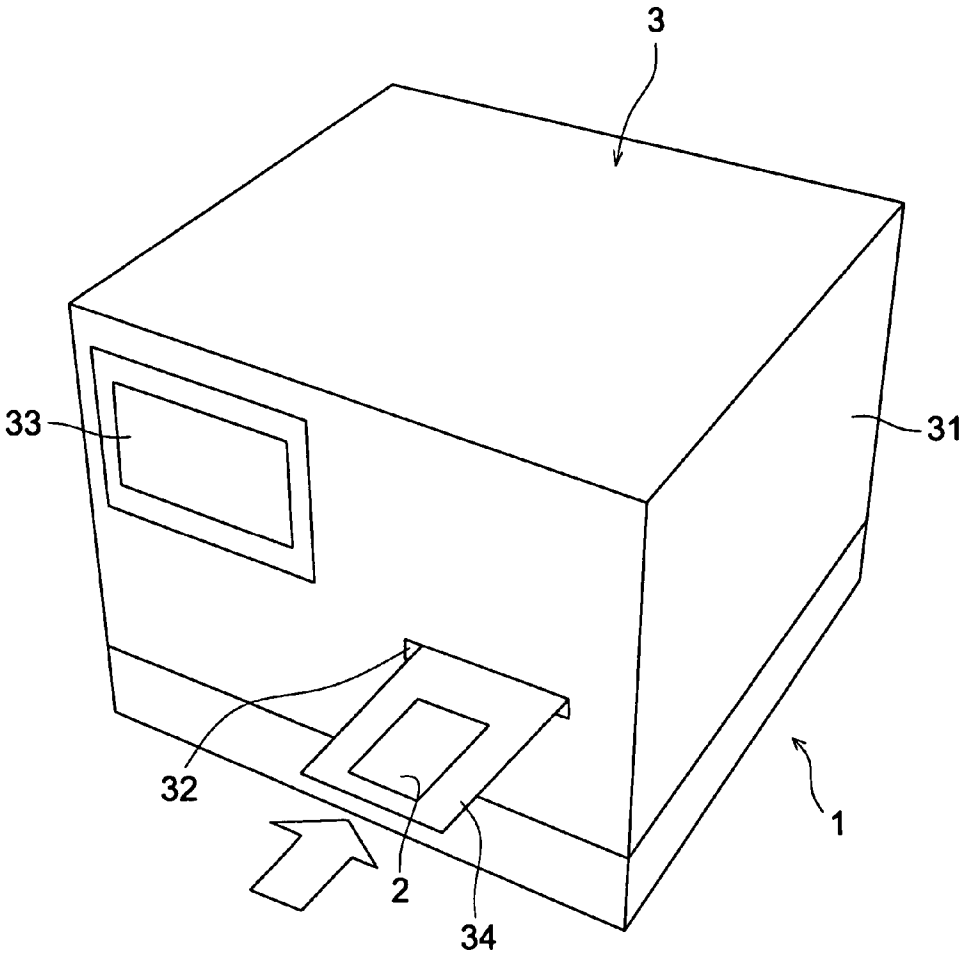
FIG. 6 is a perspective view showing an example of a micro analysis system.
Figure 7:
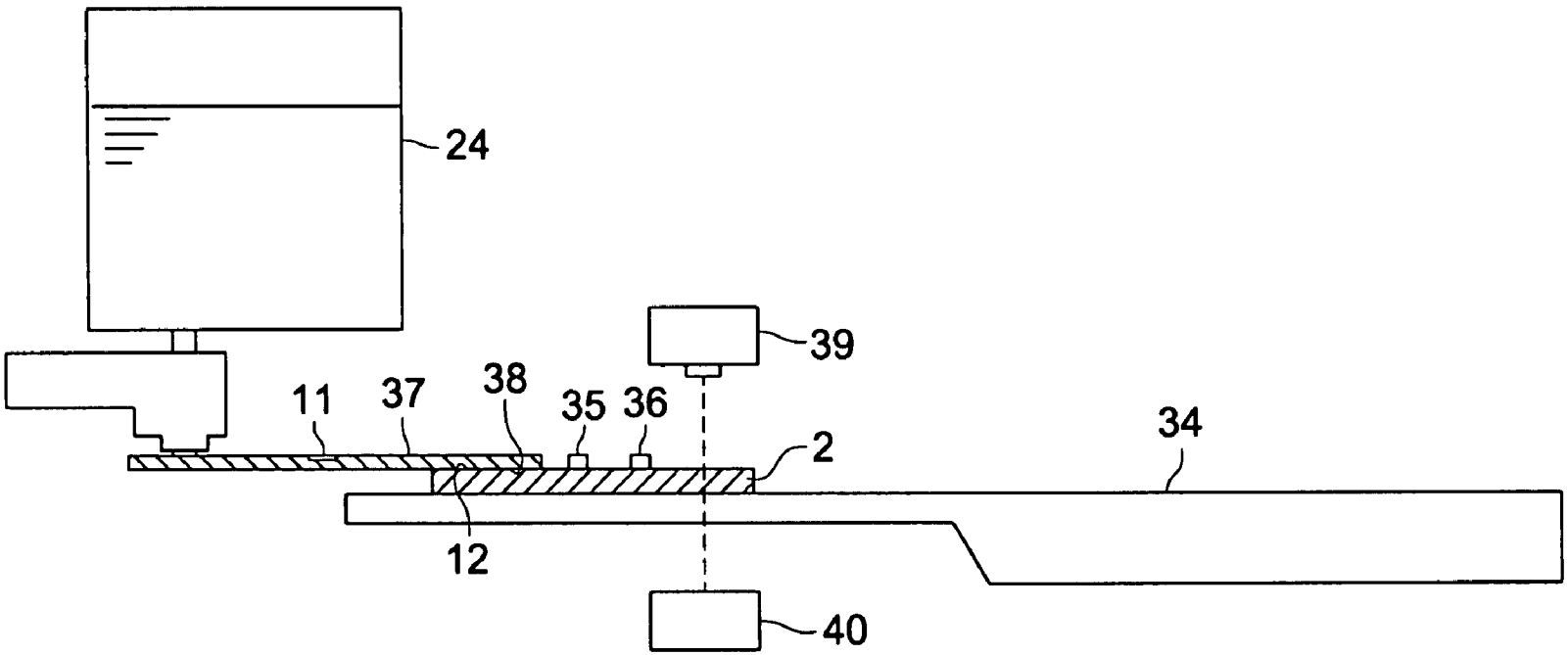
FIG. 7 is a diagram showing the inner structure of the system main body of the micro analysis system in FIG. 6.

The testing chip, described above, in accordance with the invention is, for example, mounted to an external system main body to perform reaction and analysis. This system main body and the testing chip construct a micro analysis system. An example of such a micro analysis system will be described below. FIG. 6 is a perspective view of an example of a micro analysis system, and FIG. 7 is a diagram showing the inner structure of the system main body of the micro analysis system.

The system main body 3 of the micro analysis system 1 includes a base main body 31 with a housing structure to store various devices for analysis. In the base main body 31, there is disposed a micro-pump unit 37 provided with a chip connecting section 38 having flow channel openings to communicate with the testing chip 2 and a plurality of micro pumps 11.

Further, in the base main body 31, there are provided a detection processing device (an LED, photomultiplier, light source 39 such as a CCD camera, detector 40 for optical detection by visible spectrophotometry, fluorescent photometry, or the like) for detection of reaction in the testing chip 2 and a controller (not shown) to control the detection processing device and the micro-pump unit 37. This controller performs control of liquid feed by the micro-pump unit 37, control of the detection processing device for detection of reaction in the testing chip 2 with an optical device or the like, temperature control of the testing chip 2 with a heating and cooling unit described later, control of reaction in the testing chip 2, collection measuring) and processing of data, and the like. The micro-pump unit 37 is controlled, according to a program for which various conditions related to the liquid feeding order, flow amount, timing, etc. are previously set, and by applying respective suitable driving voltages to the micro pumps 11.

The pump connecting section 12 of the testing chip 2 includes flow low channel openings, which are provided on the upstream side of micro flow channels of the testing chip 2 (for example, the upstream side of a reagent storage section, specimen storage section, and the like), and a chip surface surrounding the channel openings. In the micro analysis system 1, the testing chip 2 is mounted inside the base main body 3 in a state where the pump connecting section 12 of the testing chip 2 and the chip connecting section 38 of the micro-pump unit 37 are in liquid-tight contact, and then a target substance in the specimen in the testing chip 2 is analyzed. The testing chip 2 is loaded on a conveying tray 34 and then introduced from a chip insertion opening 32 into the base main body 31.

Inside the base main body 31, there is mounted a heating and cooling unit (a Peltier element 35 and heater 36) for local heating and cooling of the testing chip 2 disposed at a predetermined position. For example, the Peltier element 35 is pressed against a portion including a reagent storage 18 (in FIGS. 1 and 2) in the testing chip 2 to selectively cool the reagent storage section 18, thereby preventing denaturation of the reagent, and the heater 4 is pressed against a portion including the flow channels that construct the reaction section to selectively heat the reaction section, and thereby making the temperature of the reaction section suitable for reaction.

The micro-pump unit 37 can be, for example, a micro pump for which a substrate of silicon, glass, resin or the like is formed with a plurality of pump sections and the substrate surface formed with the pump sections is covered by another substrate or the like. The micro-pump unit 37 is connected with a driving liquid tank 24, and the upstream side of the micro pumps 11 communicates with the driving liquid tank 24. On the other hand, the downstream side of the micro pumps 11 communicate with flow channel openings provided at one surface of the micro-pump unit 37, and the testing chip 2 is connected with the micro-pump unit 37 such that the flow channel openings, of the micro-pump unit 37, communicating with the respective micro pumps 11 and the respective flow channel openings provided for the pump connecting section 12 of the testing chip 2 are connected.

Specifically, for example, a surface of the pump connecting section 12 of the testing chip 2 and a surface of the chip connecting section 12 of the testing chip 2 are superimposed with each other, and thereby the ports of the pump connecting section 12 and the ports of the chip connecting section 38 are connected. Thus, flow channels going from the micro pumps 11 to the micro flow channels of the testing chip 2 are formed.

The micro pumps 11 fees out driving liquid, such as an oil type including mineral oil or a water type, stored in the driving liquid tank 24 through the pump connecting section 12 to the storage sections for the respective liquids in the testing chip 2, and thus the driving liquid pushes out the liquids in the respective storage sections to the downstream side of the testing chip 2.

As the micro pumps 11, a pump driven by a piezo element disclosed in laid-open publication TOKKAI No. 2001-322099 and laid-open publication TOKKAI No. 2004-108285 can be employed. This micro pump is provided with a first flow channel of which flow path resistance varies with the pressure difference, a second flow channel having a smaller variation rate of the flow path resistance for the variation of the pressure difference, a pressure applying chamber connected to the first flow channel and the second flow channel, and an actuator that changes the inner pressure of the pressure applying chamber, wherein liquid feeding in the normal direction and the reverse direction can be performed by driving the actuator with a driving device.

The analysis process including pre-processing of a specimen to be a measured sample, reaction, and detection is performed in a state where the testing chip 2 is mounted to the system main body 1 in which micro pumps, the detection processing device, and the controller are incorporated. Preferably, liquid feeding of the sample and reagents, pre-processing, a pre-determined reaction based on mixing and optical measuring are automatically performed as a series of continuous processes, and measured data is stored in a file along with necessary conditions and recorded matters. The result of analysis is displayed on a display section 33 of the base main body 31, shown in FIG. 6.

A concrete example of reaction between a specimen and reagents by the use of a testing chip in accordance with the invention will be described below. In a chip in a preferred embodiment of a testing chip, there are provided a specimen storage section into which a specimen or analyte (for example, DNA, RNA, gene) extracted from the specimen is injected, a specimen pre-processing section that conducts pre-processing of the specimen, a reagent storage section that holds a reagent to be used for a probe combination reaction and a detection reaction (including also a gene amplification reaction or an antigen-antibody reaction), a positive control storage section that holds a positive control, a negative control storage section that holds a negative control, a probe storage section that holds a probe (for example, a probe to hybridize to a gene to be detected that is amplified by a gene amplification reaction), a micro flow channel that is communicated with respective storage sections and a pump-connecting section that can be connected to a separate micro pump capable of feeding liquids in the respective storage sections and the channel.

To the testing chip, there is connected a micro pump through a pump-connecting section, and thereby, a specimen held in a specimen storage section or a bio-material extracted from the specimen (for example, DNA or other bio-materials) and reagent held in a reagent storage section are fed to a downstream flow channel and are mixed to react with each other at a reaction part of the micro flow channel, for example, at a part of gene amplification reaction (such as an antigen-antibody reaction, in the case of protein). Then, a processing liquid having processed the reacted liquid and a probe held in a probe storage section are fed to a detection section located in the channel at the downstream side thereof to be mixed in the flow channel and combined with each other (or hybridized), thus, the bio-material is detected based on this reaction product.

Further, in the same way as in the foregoing, the reaction and detection are conducted also for positive control held in the positive control storage section and negative control held in the negative control storage section.

A specimen storage section in the testing chip is communicated with a specimen injecting section which holds a specimen temporarily and supplies the specimen to a mixing section. It is desirable that the specimen injecting section through which the specimen is injected into the specimen storage section from its upper side is provided with a plug that includes an elastic body such as a rubber type material, or the specimen injecting section is covered by resin such as polydimethylsiloxane (PDMS) or by a reinforced film, for preventing leakage to the outside, infection and pollution and for securing tight sealing. For example, the specimen in syringe is injected by a needle pierced through the plug made of rubber material, or by a needle penetrating a thin hole having a cap.

In the case of the former, it is preferable, that, when the needle is pulled out, the hole made by the needle is closed immediately. Or, some other specimen injecting mechanism may also be provided.

If necessary, the specimen injected into a specimen storage section is subjected to preprocessing through mixing of the specimen and the processing liquid, for example, before mixing the specimen with reagent in the specimen preprocessing section provided on the flow channel in advance. Such a specimen preprocessing section may include a separation filter, resin for adsorption and beads. Preferable specimen preprocessing includes separation or concentration analyte, and deproteinization. For example, bacteriolysin, such as a 1% SDS mixed solution, is used to perform bacteriolysis and DNA extraction. In this process, a DNA is discharged from inside a cell and adsorbs to the membrane surface of a bead or filter.

Further, in the reagent storage section of the testing chip, there is sealed a predetermined amount of necessary reagent in advance. Accordingly, it is not necessary to fill necessary amount of reagent each time of using, the chip being ready to use at any time. When analyzing bio-materials in the specimen, respective reagents which are necessary for measurement are usually known. For example, when analyzing an antigen existing in bio-materials, there is used reagent containing an antibody corresponding to the antigen, preferably containing monoclonal antibody. The antibody is preferably marked with biotin and FITC.

Reagents for genetic test may include various reagents used for gene amplification, probes used for detection and color forming reagents, and also preprocessing reagents used for specimen preprocessing, if necessary.

Specimen solution and reagent solution are pushed out from the respective storage sections to be mixed when driving liquid is fed by a micro pump so that reaction starts which is necessary for analysis, such as gene amplification reaction, trapping of an analyte or antigen-antibody reaction.

As a DNA amplification method, a PCR amplification method which is used commonly in many aspects can be used including improvements.

In the PCR amplification method, it is necessary to control temperature to raise and drop the temperature between three temperatures, and a channel device capable of controlling temperatures suitable for a micro chip has already been proposed by the inventors of the present invention (TOKKAI No. 2004-108285). This device system can be applied to a flow channel for amplification of a chip in accordance with the invention. Thus, DNA amplification can be carried out in a period that is much shorter than that by a conventional method wherein DNA amplification is carried out manually, because thermal cycle can be switched at high speed, and micro flow channel is made to be a micro-reaction cell whose heat capacity is small.

By the ICAN (Isothermal chimera primer initiated nucleic acid amplification) method developed, DNA amplification can be carried out in a short period of time at an arbitrary constant temperature in a range of 50-65° C. (U.S. Pat. No. 3,433,929). Therefore, the ICAN method is a suitable amplification technology for a system in accordance with the invention. This method which takes one hour in manual operations is completed in 10-20 minutes, preferably in 15 minutes in a system in accordance with the invention. On the downstream side of the reaction part in the micro flow channel of the testing chip, there is provided an analyte, for example, a detection part for detecting an amplified gene.

At least its detecting portion is of a transparent material for making optical measurement possible, and preferably of transparent plastic.

Further, protein having affinity to biotin adsorbed to the detection part on the micro flow channel (avidin, strepto avidin) combines specifically with biotin marked on probe material, or biotin marked on 5' end of primer used for gene amplification reaction. Due to this, a probe marked with biotin or amplified gene is trapped at the detection part.

Though a method for detecting separated analyte or DNA of amplified target gene is not limited in particular, the following process is basically carried out as a preferred embodiment.

(1a) Specimen, DNA extracted from the specimen, or cDNA compounded through reverse transfer reaction from RNA which is extracted from the specimen, and primer biotin-modified at 5' position are sent from their storage sections to a micro flow channel located on the down stream side.

After the process of amplification reaction of a gene in a micro flow channel of a reaction part, amplification reaction liquid containing gene amplified in the micro flow channel and a denatured liquid are mixed to denature the amplified gene into a single strand, and this and probe DNA of which end is fluorescence-marked with FITC (fluorescein isothiocyanate) are hybridized.

Then, a liquid is fed to the detection part in the micro flow channel where protein having affinity to biotin is adsorbed, and the amplified gene is trapped in the detection part in the micro flow channel. (Fluorescence-marked Probe DNA may be hybridized after the amplified gene is trapped in the detection part.)

(1b) A reagent containing antibody specific for the analyte such as an antigen, a metabolite and hormone existing in a specimen, preferably monoclonal antibody, is mixed with the specimen. In this case, the antibody is marked with biotin and FITC. Therefore, a product obtained through an antigen-antibody reaction has therein biotin and FITC. This product is sent to a detection part, in the micro flow channel, which has adsorbed biotin-affinity protein (preferably, streptoavidin) to be fixed on the detection part through the combination of the biotin-affinity protein and the biotin.

(2) A gold-colloidal liquid whose surface is modified with anti-FITC antibody that combines specifically with FITC is let to flow -into the micro flow channel, and thereby, the gold colloid is adsorbed by the fixed FITC of analyte or antibody reactant or by FITC modified probe hybridized with a gene.

(3) The concentration of the gold colloid in the micro flow channel is measured optically.

An embodiment of the present invention has been described above, however, the invention is not limited thereto, and various alterations and modifications are possible without departing from the scope of the present invention.

In accordance with the invention, reagent sealed in a reagent section in advance is prevented from denaturation through evaporation or the like during storage or from leaking out to an external flow channel. Further, it is easy to make reagent flow from a reagent storage section to a successive flow channel when using the reagent.

Still further, in accordance with the invention, it is possible to feed reagent properly to a successive process.

What is claimed is:

1. A testing chip for analysis of a specimen, comprising:

a reagent storage section that stores an aqueous reagent in advance;

a mixing and reaction flow channel to perform a series of operations to mix a specimen and the aqueous reagent, make the specimen and the aqueous reagent react with each other, and detect the reaction;

a first flow channel from the reagent storage section in a downstream direction;

a second flow channel that branches from the first flow channel and feeds the aqueous reagent to a next process;

a first liquid feed control section coated with a hydrophobic material;

a second liquid feed control section coated with the hydrophobic material; and a detection part that detects the reaction on a downstream side of the first and second liquid feed control sections;

wherein:

each of the first and second liquid feed control sections: includes a micro path via which flow channels on an upstream side and downstream side communicate with each other, has a flow channel cross sectional area smaller than the communicating flow channels, prohibits passing of a liquid until the liquid feed pressure in a vicinity of an inlet of the micro path reaches a respective predetermined pressure, and allows passing of the liquid when the liquid feed pressure is higher than or equal to the predetermined pressure;

the liquid feed pressure that allows passing of the liquid is lower at the second liquid feed control section than at the first liquid feed control section;

the first liquid feed control section is disposed for the first flow channel at a position ahead of a branch point with the second flow channel;

the second liquid feed control section is disposed for the second flow channel and near the branch point from the first flow channel;

the first and second liquid feed control sections, an outlet flow channel of the reagent storage section and an inlet of the mixing and reaction flow channel are formed to have a width of 50 to 100 μm, and a depth of 25 to 400 μm; and the aqueous reagent, a lipophilic liquid, and an aqueous liquid having a greater surface tension than the aqueous reagent are disposed in the reagent storage section in order toward the outlet flow channel, the aqueous liquid being stored in contact with the liquid feed control sections.

2. A micro analysis system comprising:

the testing chip of claim 1; and a system main body, wherein:

the system main body includes a micro pump unit provided with a chip connecting section having flow channel openings to communicate with micro flow channels of the testing chip and a plurality of micro pumps, a detection processing device to detect a reaction in the testing chip, and a control device to control the micro pump unit and the detection processing device;

the testing chip includes a pump connecting section having flow channel openings to communicate with the micro pumps; and the testing chip is mounted inside the system main body in a state in which the pump connecting section of the testing chip and the chip connecting section of the micro pump unit are in tight liquid contact, and then a specimen in the testing chip is analyzed.

* * * * *